United States Patent [19]

Kendall

[11] 3,937,207

[45] Feb. 10, 1976

[54] RANGE TOP HOLD-DOWN AND PILOT LIGHT FLASH TUBE

[75] Inventor: Willard E. Kendall, Elgin, Ill.

[73] Assignee: Winnebago Industries, Inc., Forest City, Iowa

[22] Filed: Sept. 30, 1974

[21] Appl. No.: 510,509

[52] U.S. Cl. ..... 126/39 B; 126/214 A; 403/227; 431/191

[51] Int. Cl.[2] ..... F24C 3/00

[58] Field of Search ..... 126/39 R, 39 B, 214 A; 431/191; 403/227, 350, 368, 372

[56] References Cited

UNITED STATES PATENTS

| | | | |
|---|---|---|---|
| 2,078,471 | 4/1937 | Tinnerman | 126/39 B |
| 2,851,029 | 9/1958 | Fry et al. | 126/39 B |
| 2,991,783 | 7/1961 | Saponara | 431/191 X |
| 3,013,643 | 12/1961 | Perry | 403/227 X |

*Primary Examiner*—Edward G. Favors

*Attorney, Agent, or Firm*—Burd, Braddock & Bartz

[57] ABSTRACT

A cooking gas range equipped with an oven door having a vertical window allowing visual inspection of oven and broiler compartments. The top of the range is held on a fixed support with a hold down assembly. Hold down assembly has a tubular member which serves as a flash tube for the pilot light burner and an expandable sleeve releasably mounted on the fixed support.

21 Claims, 7 Drawing Figures

FIG. 1
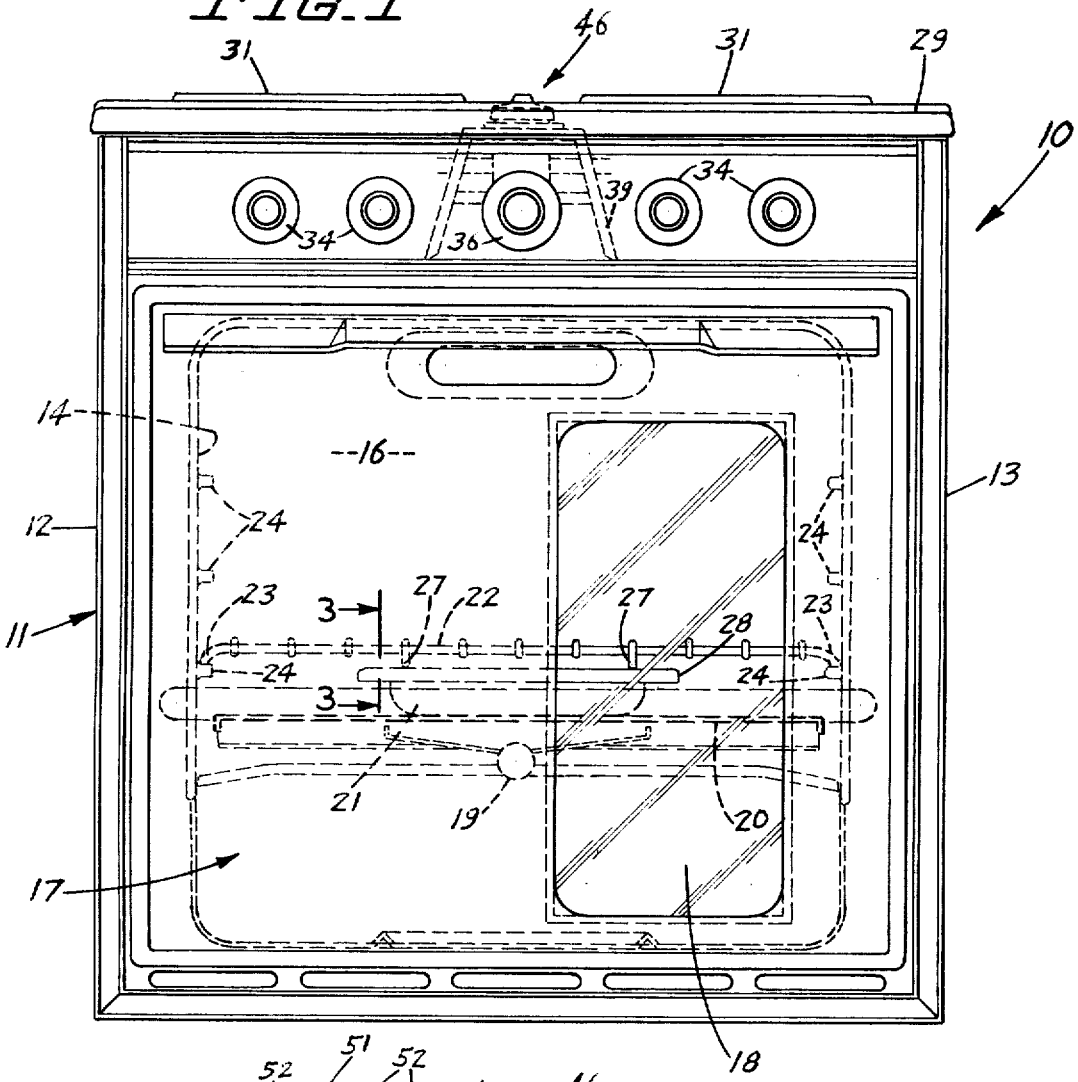
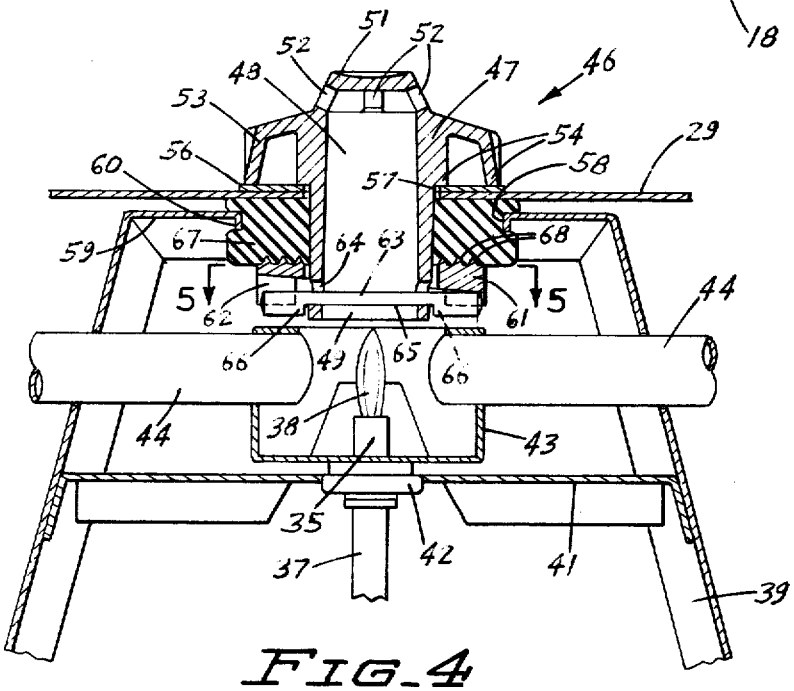
FIG. 4
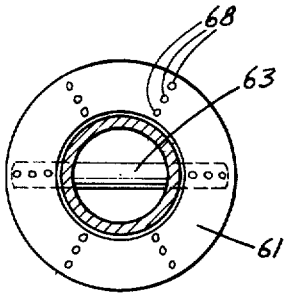
FIG. 5

FIG. 2
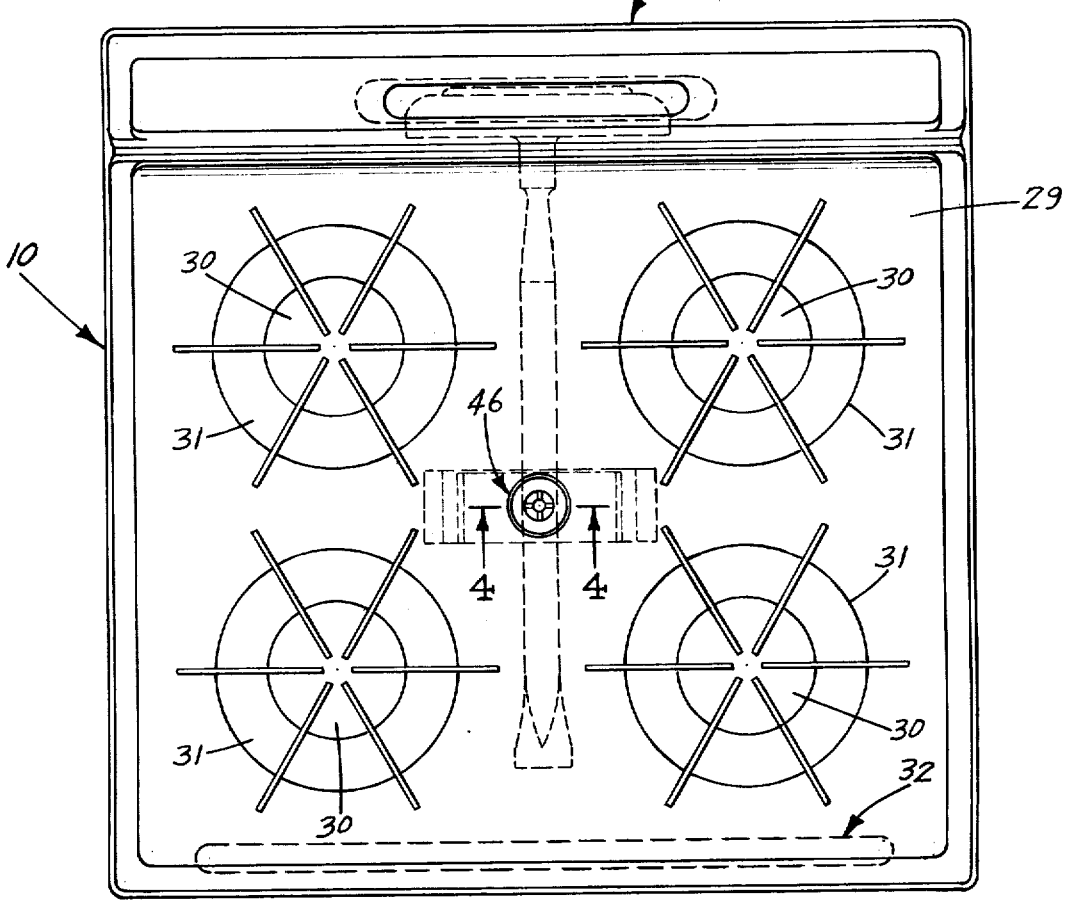
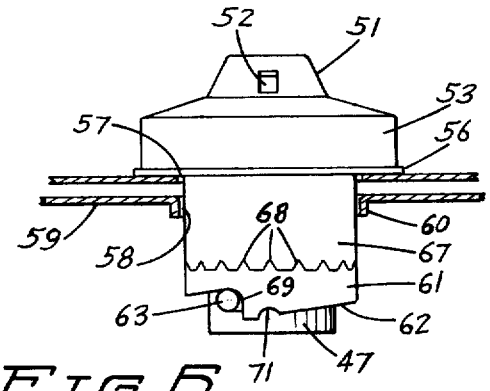
FIG. 6
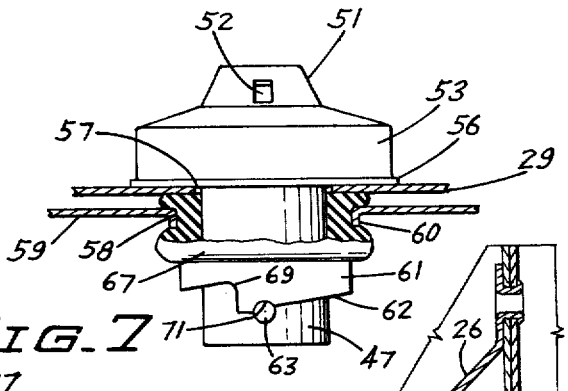
FIG. 7
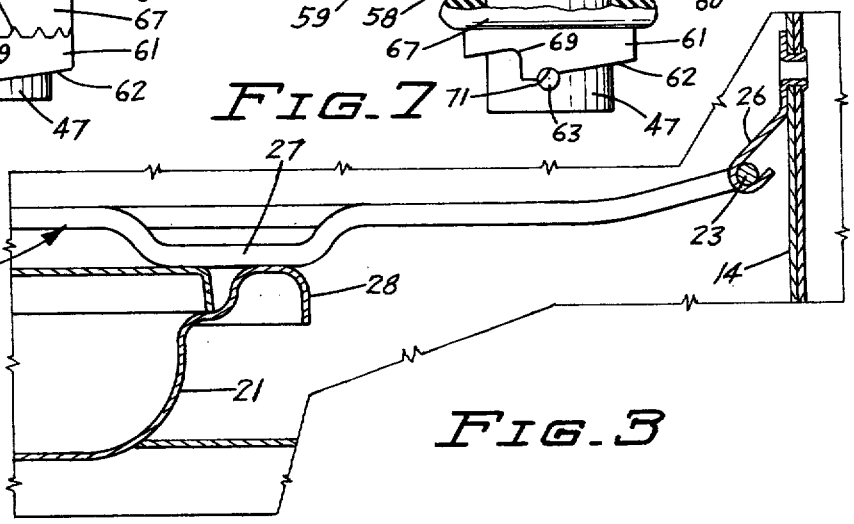
FIG. 3

RANGE TOP HOLD-DOWN AND PILOT LIGHT FLASH TUBE

BACKGROUND OF THE INVENTION:

Recreational vehicles as campers, travel trailers, and motor homes are usually equipped with cooking units or gas ranges. The ranges are built into the cabinet structure of the vehicle where they are readily accessible to the user of the vehicle. Conventional ranges have a plurality of gas burners located under a top. A pilot light is used to ignite the burners. Normally the pilot light is turned off during the movement of the vehicle. Prior to the use of the gas range, the pilot light is lit so that the gas burners will be automatically ignited when the gas control valves are turned on. The top of the gas range must be fixed to prevent the rattles and escape of the top from the housing in the event of an abrupt stop of the vehicle. Clamps and attaching structures are used to connect the tops to the frames of the gas ranges. An example of attaching structure is shown by Zink in U.S. Pat. No. 1,781,623. Zink utilizes a bolt to hold the top of a gas burner in assembled relation with a fixed frame. Kauffman in U.S. Pat. No. 2,081,819 shows a pilot light housing carried on a tray located over the burners. The pilot light housing is not used to attach the tray to a fixed support.

SUMMARY OF THE INVENTION:

The invention is directed to improve gas range structure which facilitates the holding of the top of the range in a safe and secure position and permits the igniting of the pilot light from the top of the range. More particularly, the invention is directed to a pilot light hold down assembly used to hold the top of a gas range in a fixed position and usable as a flash tube to facilitate the lighting of the pilot light of the gas range. The hold down assembly has a tubular member open at its bottom end above the pilot light burner and open at its upper end above the top plate of the gas range. The tubular member functions as a flash tube during the ignition of the pilot light burner. An expanding means associated with the tubular member is operable to fixedly secure the top plate of the range to a fixed support. The expandable member includes a resilient sleeve that expands in response to the compression of the sleeve. A ring member associated with the sleeve and the tubular member operates in response to rotation of the tubular member to compress the sleeve thereby mount the top of a fixed support.

Another feature of the invention is a range having a door with an elongated vertical window whereby both the oven compartment and broiler compartment can be simultaneously viewed. A further feature of the invention is the provision of a rack for an oven compartment having a structure which minimizes the movement and rattling of the rack and tray located below the rack.

An object of the invention is to provide a gas range with a top hold down operable to minimize the noise and to prevent the inadvertent separation of the top of the range from the range housing. A further object of the invention is to provide a top hold down structure for a range with a pilot lighting passage. A further object of the invention is to provide a range door with a vertical window whereby the upper and lower compartments of the range can be visually inspected. A further object of the invention is to provide an oven rack for a range with a structure operable to hold a tray or pan in a fixed position. IN THE DRAWINGS:

FIG. 1 is a front elevational view of a cooking range having the door and pilot light hold down structure of the invention;

FIG. 2 is a top plan view of FIG. 1;

FIG. 3 is an enlarged sectional view taken along line 3—3 of FIG. 1;

FIG. 4 is an enlarged sectional view taken along line 4—4 of FIG. 2;

FIG. 5 is a sectional view taken along line 5—5 of FIG. 4;

FIG. 6 is a side view of the pilot light hold down in the release position; and

FIG. 7 is a side view similar to FIG. 6 showing the pilot light hold down in the lock position.

DESCRIPTION OF PREFERRED EMBODIMENT:

Referring to FIG. 1, there is shown a gas range or cooking unit indicated generally at 10 having oven and counter heating units. Range 10 is a gas range suitable for use in recreational vehicles, mobile homes, and like environments. Range 10 has a generally rectangular housing 11 comprising upright side wall 12 and 13. An inside wall 14 surrounds the oven chamber 16. A door 17 closes the front of the chamber 16. The door 17 is connected to the side walls 12 and 13 with conventional hinges (not shown) whereby the door can be moved to open and closed positions. Door 17 has an upright rectangular window 18. Window 18 extends from the bottom of the door to the top of the door and is located in one side portion of the door to provide for visual inspection of both the oven and broiler compartments of the range. The window 18 has a vertical length approximately twice the horizontal width. Other sizes of windows can be used in door 17.

A gas burner 19 is located in chamber 16 above the bottom of the chamber to separate the chamber into an upper oven compartment and a lower broiler compartment. A generally flat oven bottom 20 is located above the burner 19. An oven rack 22 comprising a plurality of transverse longitudinal connected wire members is located above oven bottom 20. Oven rack 22 has an outer peripheral member 23 that engages a plurality of supports 24. Supports 24 are secured to the inside wall 14.

As shown in FIG. 3, oven rack 22 is connected to hook members 26 secured to the back portion of the inside wall 14. Two rod portions of the oven rack 22 have downwardly offset sections 27 which engage the top rim 28 of the broiler pan 21 when the oven rack 22 is in its lowest position. The oven rack 22 being in engagement with the broiler pan 21 holds the broiler pan 21 in a fixed position between rack 22 and oven bottom 20, thereby minimizing the movement and rattling of the pan 21. As shown in FIG. 1, oven rack 22 has a plurality of downwardly directed portions 27 which engage separate parts of the rim 28 of the broiler pan 21. Preferably, four sections 27 engage separate corner portions of the broiler pan 21.

Referring to FIG. 2, the range 10 has a generally rectangular top 29 having four spaced holes 30 located above the gas burners 31. A main gas line or gas manifold 32 extends side to side in the front area under the top 29 in front of the burners. The gas distribution from the manifold 32 supplies gas direct to the burners 31. As shown in FIG. 1, burner controls 34 and pilot light control 36 are mounted on the front of the range above the door 17. Controls 34 are operable to control the supply of gas to the burners 31. In similar manner, control 36 is operable to control the supply or gas to the pilot light burner 35, and the oven burner.

Referring to FIG. 4, pilot light burner 35 is located below the top 29. Pilot light burner 35 is connected to gas supply line 37. Flame 38 is operable to light the gas supply to the cooking burners 31. Pilot light burner 35 is mounted on a fixed frame 39. The frame 39 has a transverse platform 41. A fastener 42 attaches the pilot light burner 35 to the center portion of platform 41. A generally cup shaped housing 43 mounted on the fastener 42 surrounds the burner 35 and flame 38. Housing 43 has an open top and side openings permitting air to flow through the housing. A plurality of feeder pipes 44 mounted on the housing 43 extend to the cooking burners 31. The ends of the pipes 44 are open to the interior of the housing 43 so that gas carried by the pipes will flow into the housing 43. The flame 38 will ignite the gas thereby light the cooking burners 31.

A top hold down and pilot flash tube assembly indicated generally at 46 is mounted on the top 29 directly above the pilot burner 35. As shown in FIG. 2, the assembly 46 is located in the center portion of the top 29. In use assembly 46 functions to lock down the top 29 so that it cannot be inadvertently moved from the housing of the range or rattled during the movement of the range or vehicle carrying the range. Assembly 46 also contains a passage 48 leading to the area above the pilot burner 35 whereby the pilot light can be ignited from the top of the range.

Returning to FIG. 4, hold down and pilot flash tube assembly 46 has a downwardly directed tubular body 47 having a longitudinal passage 48. The bottom end 49 of the passage 48 is open and in vertical alignment with the flame 38. The top of the body 47 has a cap 51. The cap 51 has a plurality of lateral holes 52 which connect the passage 48 to the outside atmosphere. The pilot light burner 35 can be lit with the use of the flame held adjacent to the outside of holes 52 since the gas from the pilot light burner will move upwardly through passage 48. The igniting gas will burn the gas in passage 48 and thereby establish the flame 38.

The upper part of body 47 has an outwardly directed head 53. Head 53 has shoulders 54 which face the top 29. The top 29 has a hole 57 for accommodating the central portion of body 47. Body 47 extends through a larger hole 58 in the top member 59 of the frame 39. Member 59 has an annular flange 60 surrounding hole 58. A ring 61 is mounted on the lower portion of body 47. Ring 61 has a pair of diametrically opposed inclined ends 62 accommodating ends of a transverse pin 63. Pin 63 extends through transverse aligned holes 64 in the lower end of body 47 so that pin 63 will rotate with the body 47. Pin 63 has a central cut out 65 having a length slightly longer than the outside diameter of body 57 whereby the pin 63 has stop edges 66 engageable with portions of body 47 to prevent the pin from drifting out of the hole 64. A resilient collar or sleeve 67 is located between the ring 61 and the bottom of top 29. The sleeve 67 can be a resilient rubber or plastic member that expands when compressed. The sleeve 67 is concentrically positioned on the tubular body 47 and extends through the hole 58. The ring 61 has a plurality of upwardly extended ribs or projection members 68 which engage the lower surface of washer 67 to prevent the rotation of ring 61 along with the rotation of the body 47. FIG. 5 shows the preferred shape of the ribs 68 on the upper surface of the ring 61. As shown in FIG. 6 and 7, inclined end 62 has a helical shape so that the ring 61 will longitudinally slide on body 47 when the body is rotated relative to ring 61. End 62 is a camming surface in engagement with the ends of pin 63. FIG. 6 shows the ring 61 is the release position with pin 63 in deep pockets 69 of end 62. The sleeve 67 has a generally cylindrical shape and size to freely extend through holes 57 and 58. The top 29 can be removed from the range housing when the sleeve 67 is in its elongated release position.

FIG. 7 shows ring 61 in the hold position. Pin 63 has been rotated by turning body 47. The ends of pin 63 move along camming surface 62 from pocket 69 to holding recess 71. Ring 61 slides axially toward head 53 compressing sleeve 67. Sleeve 67 expands around flange 60. Top 29 is then clamped between washer 56 and the top of sleeve 67.

In use, the top hold down and pilot flash tube assembly 46 functions to releasably attach the top 29 in a fixed manner to the fixed frame 39. The resilient sleeve 67 is compressed and expanded about the annular flange or edge 60 of top member 59 forming the hole 58. The upper portion of the sleeve 67 expands between top 29 and support 59 to space the top 29 from the support 59 and resiliently cushion the top 29. The mid portion of the resilient sleeve 67 extends around the lower side of support 59 thereby releasably attach the resilient sleeve 67 to the support 59. The compression of the sleeve 67 is accomplished by the rotation of the body 47. The head 53 is used to manually rotate the body 47. The rotation of the body 47 will turn the pin 63 relative to the inclined end or camming surface 62. This will longitudinally move the nut relative to the body 47 thereby squeeze or clamp the resilient sleeve 67 up against the top 29. The passage 48 in the tubular body 47 remains open and in alignment with the pilot light burner 35. The pilot light 37 can be ignited with a conventional match from the above of the top 29.

While there has been shown and described a preferred embodiment of the invention, it is understood that changes in the size, number, and location of the hold down and pilot flash tube assembly may be made by those skilled in the art without departing from the invention.

The embodiments of the invention in which an exclusive property or privilege is claimed are defined as follows:

1. An apparatus for holding a top of a gas range having a pilot light burner comprising: a stationary frame located adjacent to the pilot burner, a releasable holding apparatus connecting the top to the frame, said holding apparatus having a passage open above the top and open adjacent to the pilot burner whereby the pilot burner can be lit with a flame from above the top.

2. The apparatus of claim 1 wherein: the holding apparatus includes a first member projected through a hole in the top, a second member movable relative to the first member, an expandable member associated with the first member and second member, and means for moving said expandable member into a holding engagement with the stationary frame in response to relative movement between the first member and second member.

3. The apparatus of claim 2 wherein: the means for moving said expandable member includes inclined surface means on the second member and means on the first member engageable with the surface means whereby rotation of the first member will move the second member to expand the expandable member.

4. The apparatus of claim 3 wherein: the means on the first member is a pin having ends engageable with the inclined surface means.

5. The apparatus of claim 2 wherein: the first member has a tubular body projected through said hole in the top and a hole in the frame, said second member being a ring member located about said body, said expandable member being a resilient sleeve located around the body.

6. The apparatus of claim 2 wherein: the means for moving the expandable member includes inclined surface means on the second member and a pin engageable with the inclined surface means on the first member.

7. The apparatus of claim 1 wherein: said frame has a portion located below and generally parallel to the top, said portion having a hole aligned with a hole in the top, said holding apparatus having a portion extended through said holes and said expandable member extended through the hole in the portion of the frame.

8. The apparatus of claim 1 wherein: the holding apparatus includes a tubular body projected through a hole in the top, a head attached to the body, and extended over a part of the top, ring means surrounding said body, said ring means having an inclined camming surface, pin means carried by the body and engageable with the camming surface, an expandable sleeve surrounding the body between the ring means and head, said sleeve adapted to expand into holding engagement with the stationary frame and clamp the top between the head and sleeve when the pin means is rotated relative to the ring means.

9. The apparatus of claim 8 including: recesses in the ring means accommodating the pin means when the sleeve has been expanded.

10. An apparatus for holding a top of a range on a stationary member, said top and stationary member having aligned holes comprising: a first member having a body extended through said holes and a head extended over a part of the top, a second member moveable relative to the first member, an expandable member extended through said hole in the stationary member associated with the first member and second member, and means for expanding said expandable member into holding engagement with the stationary member and clamping the top between the head and expandable member in response to relative movement between the first member and second member.

11. The apparatus of claim 10 wherein: the means for moving the expandable member includes surface means on the second member and means on the first member engageable with the surface means whereby rotation of the first member will move the second member to expand the expandable member.

12. The apparatus of claim 11 wherein: the means on the first member is a pin having an end engageable with the inclined surface means.

13. The apparatus of claim 10 wherein: the expandable member is a resilient sleeve located about the body.

14. The apparatus of claim 10 wherein: the second member is a ring member having inclined surface means forming part of the means for expanding said expandable member.

15. The apparatus of claim 10 wherein: the means for expanding the expandable member includes inclined surface means on second member and a pin carried by the first member and engageable with the inclined surface means whereby rotation of the first member will move the second member and expand the expandable member into holding engagement with the stationary member.

16. An apparatus for holding a first member on a second stationary member, said members having aligned holes comprising: first means having a body extended through said holes and a head extended over parts of the first member, second means moveable relative to the first means, expandable means extended through said hole in the stationary member associated with the first means and second means, and third means for expanding said expandable means into holding engagement with the stationary member and clamping the first member between the head and the expandable means in response to relative movement between the first means and second means, said third means including inclined surface means on the second means, and means on the first means engageable with the surface means whereby rotation of the first means will move the second means to expand the expandable means.

17. The apparatus of claim 16 wherein: the means on the first means is a pin having an end engageable with the inclined surface means.

18. The apparatus of claim 16 wherein: the expandable means is a resilient sleeve located about the first means.

19. The apparatus of claim 16 wherein: the second means is a ring member having inclined surface means forming part of the third means for expanding said expandable means.

20. The apparatus of claim 16 wherein: the body of the first means has an axial passage extended through the body.

21. The apparatus of claim 16 wherein: the second means has recess means open to the inclined surface means for accommodating a portion of the means on the first means engageable with the surface means to hold the expandable means in its expanded position.

* * * * *